United States Patent [19]

Demoiseau

[11] 4,077,337

[45] Mar. 7, 1978

[54] METHOD AND INSTALLATION FOR CONTINUOUS COMBUSTION OF COMBUSTIBLES

[76] Inventor: Bernard Demoiseau, 11, rue Joseph-Cursat, 74100 Annemasse, Haute-Savoie, France

[21] Appl. No.: 701,293

[22] Filed: Jun. 30, 1976

[30] Foreign Application Priority Data

Jul. 4, 1975 Switzerland .....8715/75

[51] Int. Cl.[2] ..... F23G 5/00

[52] U.S. Cl. ..... 110/235; 110/242; 110/250; 110/346

[58] Field of Search ..... 110/1 H, 1 J, 1 P, 1 N, 110/7 R, 8 R, 18 R; 431/10, 163

[56] References Cited

U.S. PATENT DOCUMENTS

| | | | |
|---|---|---|---|
| 2,865,344 | 12/1958 | Firl | 110/1 J |
| 3,606,866 | 9/1971 | Laessig et al. | 110/1 J |
| 3,699,903 | 10/1972 | King | 110/1 J |
| 3,792,669 | 2/1974 | Ueno et al. | 110/1 J |
| 3,799,212 | 12/1973 | Wagner | 110/1 J |
| 3,838,651 | 10/1974 | Dingwell | 431/163 |

*Primary Examiner*—Kenneth W. Sprague
*Attorney, Agent, or Firm*—Silverman & Cass, Ltd.

[57] ABSTRACT

Method and installation (apparatus) for continuous combustion of combustibles effecting combustion in a closed room into which a controlled quantity of substantially pure oxygen is introduced. The gases emitted by the combustible combined with oxygen to produce a semi-continuous explosion as a first effect; also produce as a side effect, an atomization of any water present (in the form of steam) and of any gaseous combustion products within the closed room as a second effect. Energy is provided not only in the form of calorific energy from combustion, but is released as radiation, and other forms produced by the atomization of the water and gaseous combustion products, including the kinetic energy of the gaseous molecules within the closed room.

4 Claims, 3 Drawing Figures

METHOD AND INSTALLATION FOR CONTINUOUS COMBUSTION OF COMBUSTIBLES

The present invention relates to a method for the continuous combustion of mineral or organic combustibles and to an installation for carrying out this method.

This method is characterized by the fact that one effects the said combustion in a closed room in which one admits, under controlled debit, substantially pure oxygen, as a combustive, and in which is also water steam, so that the gas which are emitted by the combustible, while combining themselves with the oxygen, produce a semi-continuous explosion (first effect) producing, on its side, an atomization of the water and of the gas contained in the room (second effect).

The installation for carrying out this method is characterized by the fact that it comprises a close room provided with at least one adduction pipe connected to a source of oxygen and with a pipe for the output of the used gas, and means permitting to adjust the debit of the oxygen.

The drawing shows, by way of example, one embodiment of the object of the invention.

This installation comprises a closed room 1 in which is admitted the combustible.

The room 1 is sheltered from any input of air, its sole adduction pipe, designated by 2, being connected to a tank 3 of pure or substantially pure oxygen. A valve 4, operable for instance by means of an electric motor, which will be, in some cases, submitted to the action of an automatic control device, permits to adjust the debit of the oxygen admitted into the room 1. At last, the room is provided with an output pipe 6 for the burnt gas, the section of which, which is adjustable by means of a valve so as to permit to maintain inner the room a predetermined pressure, is much lower than the section of the output pipe of a conventional boiler, of same power, due to the fact that the combustion is fed by means of pure or substantially pure oxygen and that a volume of air five times more important would be necessary for furnishing the same quantity of oxygen.

To this respect, the experience shows that, by the said improvement of the combustion, one saves a considerable quantity of combustible. The combustion is a slow and continuous one, its speed being determined by the quantity of oxygen which is admitted into the room 1. The pressure in the room can serve as information usable for the adjustment of the debit of the oxygen.

Figure 1:
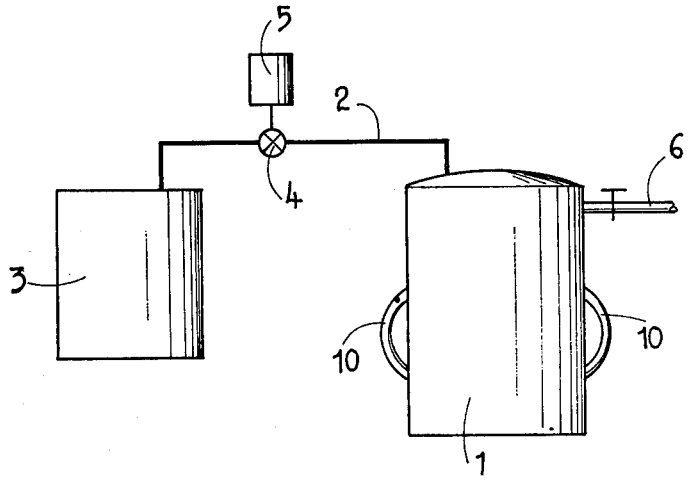
FIG. 1 is an elevational view of an installation, diagrammatically represented, serving to the combustion of mineral or organic, liquid, solid or gaseous combustibles.
Figure 2:
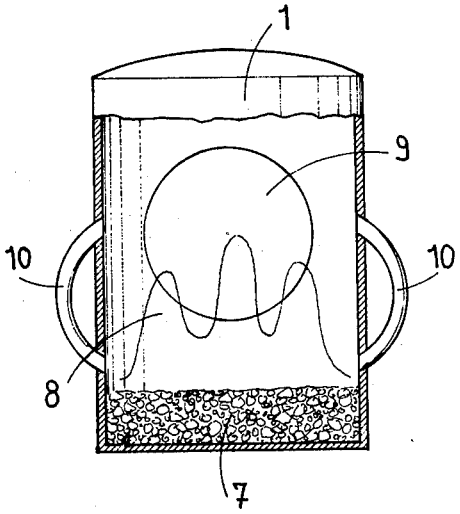
FIG. 2 is a diagrammatic sectional view of a portion of this installation, at a larger scale.

The operational process is illustrated in FIG. 2 where the room 1 has been diagrammatically sectionally represented. The combustible, for instance lignite, constitutes a bed 7 occupying the bottom of the room.

When the installation is put into service, a normal or quasi-normal combustion of the combustible 7 occurs which produces, progressively, on the one hand an increase of the temperature and on the other hand an increase of the pressure in the room.

When a certain limit of temperature and of pressure is reached, the gas emitted by the combustible, diagrammatically represented at 8, combine with the oxygen admitted into the room in a chemical combination giving raise to explosions which increase, becoming a quasi-continuous explosion. This phenomena is called here "first effect".

When the semi-continuous explosion is reached, it releases to produce a considerable and instantaneous calorific energy owing to which the water steam contained in the room is disintergrated by atomisation, as well as the gas emitted by the combustible. This phenomena which occurs in a substantially spherical zone diagrammatically indicated at 9 in FIG. 2, is called "second effect". It is to be noted that this water will come, in most cases, from the combustible itself but could also, if necessary, be admitted into the room where it vaporises itself before being atomized.

This desintegration of the water and of the gas releases a considerable quantity of energy distinct from the calorific energy contained in the combustible in the ordinary sense of the word.

It is actually matter of a continuous atomic explosion the magnitude of which is determined by the quantity of oxygen admitted into the room.

It results from these processes that the total available energy is highly greater than the calorific energy of the combustible.

Moreover, not only the calorific energy is used, but also the radiations of all kinds which are emitted by the incandescent zone 9 where is produced the atomic explosion (second effect), as well as other types of energy, for instance the kinetic energy of the gaseous molecules in movement in the room.

This energy can be used either directly for heating a fluid, for instance water, or indirectly, for instance for the production of electricity by means of gas turbines.

Figure 3:
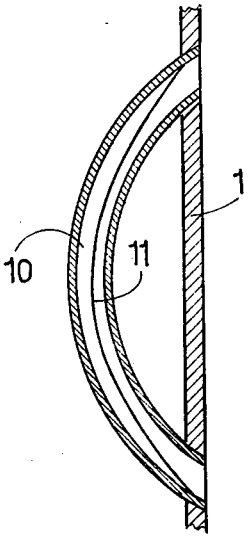
FIG. 3 is a sectional view of a detail, at a still larger scale.

The experience has shown that the process is stimulated by the presence, on the walls of the room 1, of handles like handles 10 one of which has been represented in detail in FIG. 3, in which are arranged several wires 11, of copper for instance, only one of which is visible in the drawing, which are flexible and which are welded to the curved tube constituting each handle, at the ends thereof, and which pass through this tube without contacting the wall thereof and without being in contact each with another. The handles open to room 1 at different levels thereof as shown in FIGS. 2 and 3.

The present method permits the combustion of very diverse combustibles, like town refuses, wastes of all kinds, wood, peat, lignite, coal, fuel, oils, greases, etc.

Whatever the combustible may be, even these ones burning rapidly at free air, as paper or wood, the speed of the combustion is controlled at choice. Thus, 100 g. of wood can be consumed slowly, without interruption, in 3 hours.

It results from the fact that one uses only oxygen in lieu of air so that the volume of gas admitted into the room is five times lower than that one which would be necessary for feeding the combustion with air, so that the quantity of gas to be evacuated is obviously in the same proportions with, as a consequence, the following advantages:

1. Less calories are evacuated through the burned gas.
2. These gas are more easy to be treated and to be rendered inoffensive before being rejected into the atmosphere. This can go up to the complete absorption, for instance by means of active coal.

3. Very few dust is driven by the evecuated gas, wherefrom it results a reduction of the means which have to be used for retaining it.
4. The clogging of the fire places is practically zero even in the case where wastes are burned, that obviates frequent cleanings.
5. Since the used evacuated gas have been atomized, they are less nocive.

What I claim is:

1. Method for the continuous combustion of mineral or organic combustibles, characterised by the steps of placing the said combustibles in a closed room, introducing a controlled volume of substantially pure oxygen, as a combustive into the closed room in the presence of water steam so that the gas emitted by the combustible during combination with the oxygen produce a primary effect constituting a semi-continuous explosion and as well producing a secondary effect comprising an atomization of the water and of the gas contained in the room.

2. Method as claimed in claim 1 in which the atomized water includes water emitted by the combustible during the combustion thereof.

3. Method as claimed in claim 1 in which additional water is admitted into the said room and subjected to atomization.

4. Installation for the continuous combustion of mineral or organic combustibles comprising a closed room, at least one adduction pipe connected to a source of oxygen leading to said room and an outlet pipe connected to said room for the output of the used gas, and means enabling the adjustment of the quantity of oxygen introduced to said room and at least one hollow tubular handle secured to the wall of said room and opening in the room at different levels thereof, and metallic wires arranged within the handle, said wires traversing the length of said handle spaced along their length from the wall thereof and from each other.

* * * * *